US008740005B1

(12) United States Patent
Holbrook et al.

(10) Patent No.: US 8,740,005 B1
(45) Date of Patent: Jun. 3, 2014

(54) PLASTIC TANK HAVING A CLAMPED JOINT

(75) Inventors: Paul R. Holbrook, Old Saybrook, CT (US); Roy E. Moore, Jr., Killingworth, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 194 days.

(21) Appl. No.: 13/412,406

(22) Filed: Mar. 5, 2012

Related U.S. Application Data

(60) Provisional application No. 61/449,590, filed on Mar. 4, 2011.

(51) Int. Cl.
*B65D 45/16* (2006.01)

(52) U.S. Cl.
USPC ..... 220/567.1; 220/4.13; 220/4.16

(58) Field of Classification Search
USPC ..... 220/567.1, 4.13, 4.16, 4.24, 4.12, 4.06, 220/4.07, 4.21
See application file for complete search history.

(56) References Cited

U.S. PATENT DOCUMENTS

| | | | | |
|---|---|---|---|---|
| 1,549,878 | A * | 8/1925 | Immel | 220/4.16 |
| 4,040,372 | A | 8/1977 | Flanders | |
| 4,231,482 | A * | 11/1980 | Bogan | 220/4.13 |
| 4,325,823 | A | 4/1982 | Graham | |
| 4,333,580 | A * | 6/1982 | Sweigart, Jr. | 220/4.13 |
| 5,361,930 | A | 11/1994 | Perry | |
| 5,878,907 | A | 3/1999 | Graf | |
| 6,280,614 | B1 | 8/2001 | Berg et al. | |
| 6,558,535 | B2 | 5/2003 | Berg et al. | |
| 7,572,372 | B2 | 8/2009 | Graf | |
| 7,854,338 | B2 | 12/2010 | Graf | |
| 8,070,005 | B1 * | 12/2011 | Kruger et al. | 220/4.13 |
| 2011/0293371 | A1 * | 12/2011 | Moore et al. | 405/49 |

* cited by examiner

*Primary Examiner* — Stephen Castellano
(74) *Attorney, Agent, or Firm* — C. G. Nessler

(57) ABSTRACT

An injection molded plastic tank for containing liquids, such as a septic tank, is comprised of mated half tanks which are clamped together at mating flanges. A clamp having a C-shape interior concavity has grooves which engage aligned pairs of nubs on the flange surfaces which are spaced apart from the joint surfaces of each flange. A clamp has one or more flared portions at the clamp leading edge end, leading to the grooves or to the inner concavity, to make easier installation of the clamp. When a clamp reaches its home position, the clamp is locked in place against further motion in one or both directions by interacting features on the tank and clamp.

19 Claims, 8 Drawing Sheets

PLASTIC TANK HAVING A CLAMPED JOINT

This application claims benefit to provisional application Ser. No. 61/449,590 filed Mar. 4, 2011.

TECHNICAL FIELD

The present invention relates to tanks for containing liquids, in particular to tanks which are assembled from molded plastic half tanks, especially septic tanks.

BACKGROUND

Large oblong plastic tanks, such as those for containing water or wastewater have in the past been fabricated by molding two dish-shape halves and then mating the halves at a lengthwise planar joint. This kind of construction provides an advantage over one piece plastic tanks in that half tanks may be nested for shipment and storage, potentially reducing handling and transport costs. It also enables closer control of wall thickness and better definition of interior detail. This kind of construction provides an economic and ease-of-handling advantage over typical concrete septic tanks that are heavy and comprised of halves which do not nest for transport.

In the past, half tanks may be joined to each other by adhesives or mechanical means. Adhesives have the advantage of permanency of joint. Examples of tanks made by such means include those shown in Graham U.S. Pat. No. 4,325,823 and U.S. Patent Publication 2001/0019026 of Berg et al. Mechanical joining means provide the advantage of being independent of substrate material properties, joint preparation, environment, and cure time which often relate to bonding or fusing.

Large plastic tanks, including those suitable for septic tank application, have been previously made as injection molded halves which are clamped together for use. See for example, U.S. Pat. Nos. 7,572,372 and 5,878,907 of Graf. Injection molding produces good dimensional control and fidelity, compared to tanks made by fiberglass resin layup or to polyolefin tanks made in one or more pieces by blow molding or rotational molding as shown in Kruger U.S. Pat. No. 8,070,005.

When a septic tank is an assembly of mechanically mated halves, it is important that the seal of the joint between half tanks be sound, to prevent flow into or out of the tank through the joint region. In contrast to typical concrete septic half tanks which are typically mated at the point of installation in the soil, molded plastic septic tanks of the type described in the Graf patents and the present invention can be assembled at a work place remote from the factory and then transported a relatively short distance to the point of use, where they may be lifted from a truck and placed in a pit. Often an assembled tank is dragged across the surface of the earth to the point of installation. Occasionally, a tank may be dropped from a truck bed or other transporter. Thus, the means for holding the halves together must be sufficient to reasonably endure such kinds of mechanical forces.

SUMMARY

An object of the invention if to provide a septic tank comprised of mechanically mated half tanks which is strong under conditions of transport and use and which is leak resistant and durable during use. A further object is to provide means for mechanically holding together mated half tanks that does not require special tools and that can reliably be carried out in the field, and is economical to manufacture on a mass production basis.

In accord with the invention, a tank is formed by joining together half tanks at mating flanges, and the flanges are held together with a multiplicity of clamps having a C-shape cross section. In an embodiment of the invention, each clamp has a groove-containing concavity and slides lengthwise to engage aligned pairs of nubs, which mating nubs pairs project from the surfaces of the mated flanges which surfaces are away from the surfaces which form the joint.

In different embodiments of the invention, the surface of one nub or an aligned nub pair may be either sloped or parallel relative to the surface of the other nub. The concavity of the clamp which engages the such aligned nub pairs have interior opposing side grooves. Lengthwise motion of the clamp causes the nubs, and thus the flanges, to be drawn together to form a tight joint, within which is typically a resilient seal.

In embodiments of the invention, an end of a clamp concavity comprises one or more flared portions. A flare portion running transverse to the claim length enables a clamp, when first being engaged with an aligned nub pair, to be angled about a vertical axis which is nominally perpendicular to the plane of the joint. This makes easy clamp installation, particularly when the clamps are close together. Other flare portions run from the bottoms of the grooves, to ease the engagement of the free surfaces of the nubs with the bottoms of the grooves, as the flanges are being forced toward each under, to compress a resilient gasket between the flanges.

When a clamp reaches its desired home position, a clamp may self-lock from further motion in one or both lengthwise directions by engagement of the clamp with a mating feature on the wall or flange of the tank. In one embodiment, there is a tooth on the wall of the tank which engages a notch in the side of the clamp, and contact portions of the mating locking parts are substantially perpendicular to the lengthwise direction of clamp motion.

Tanks of the present invention exist in kit form, that is, as components which can be easily and economically transported, with the half tanks nested with each other, so they can be assembled at the point of fabrication or of use. Alternately, tanks of the present invention exist in assembled form. The invention achieves the objects which are set forth above.

The foregoing and other objects, features and advantages of the present invention will become more apparent from the following description of preferred embodiments and accompanying drawings.

DESCRIPTION

While the invention is described in terms of a septic tank embodiment, it will be appreciated that the features of the invention can be applied to tanks suited for other uses. Typical characteristics and functional aspects of septic tanks are described in commonly owned patent application Ser. No. 12/445,774 of K. Kruger et al. and Ser. No. 12/445,774 of R. Moore Jr. et al. both filed Jun. 5, 2009, where a one-piece rotationally molded tank is described. The disclosures of the foregoing applications are hereby incorporated by reference.

Figure 1:
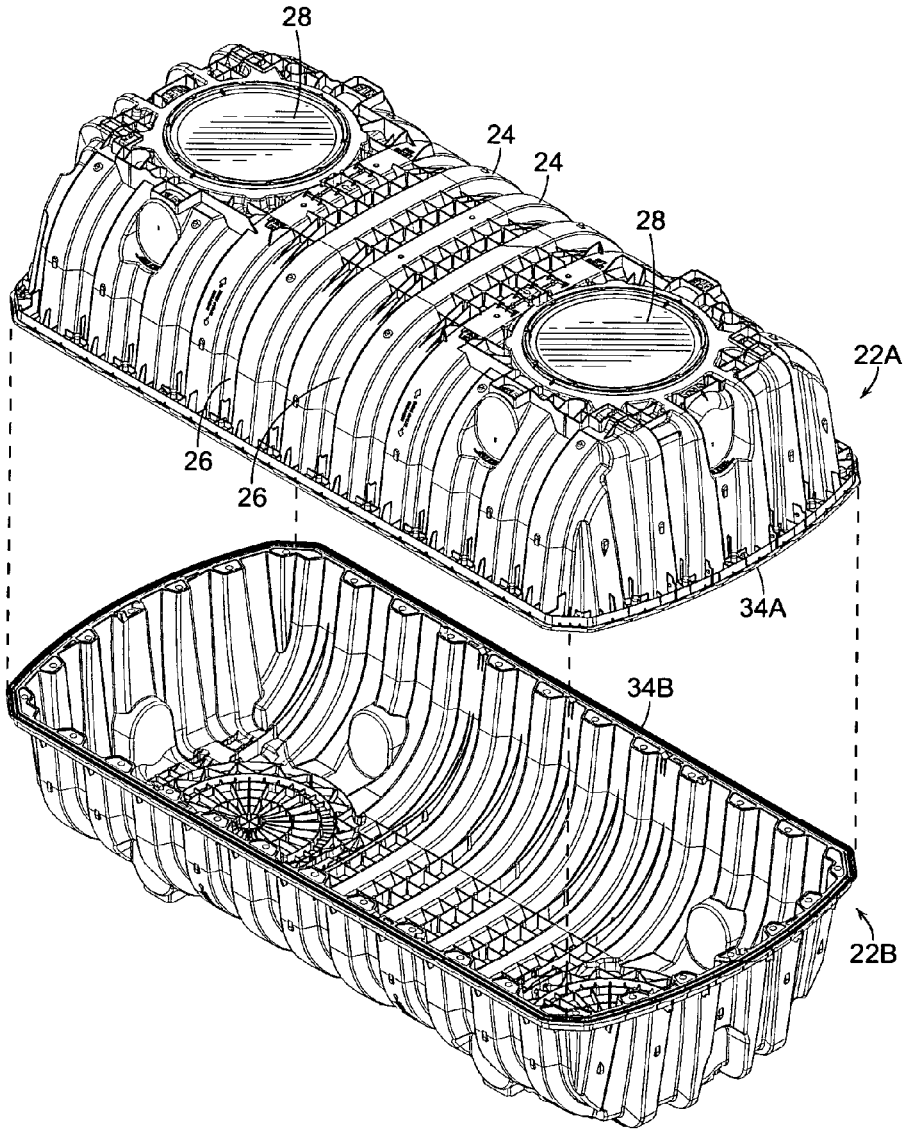
FIG. 1 is an exploded view showing how two molded concave half tank parts are mated at a horizontal flange joint to form a septic tank.
Figure 2:
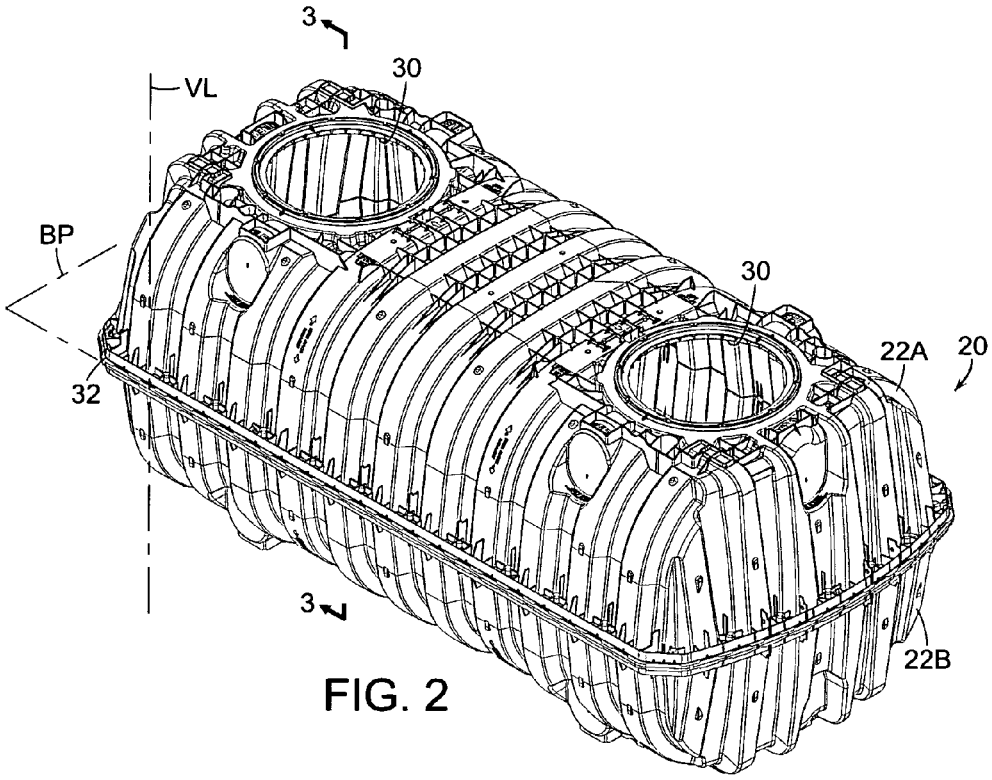
FIG. 2 shows a two part septic tank which results from the assembly illustrated in FIG. 1.

FIGS. 1 and 2 illustrate how a septic tank 20 is fabricated by mating two identical injection molded plastic septic half tanks 22A, 22B at a horizontal center plane joint 32. In the following description, an element identified by a number having a letter suffix generally corresponds with an element having the same number without suffix. And a number used without a suffix refers to a feature which is common to each of the two identical half tanks. The terms horizontal, vertical, etc. are used for convenience of description and should not be considered as limiting, inasmuch as in the generality of the invention, tanks can be used in any orientation. While the invention is described in terms of identical half tanks, the invention will be useful with tanks in which the two mating parts are unequal in volume, and thus the term half tank should be construed accordingly as applying those constructions. And while planar flanges and joints are shown in the Figures here, the invention will be applicable to tank assemblies where the flanges have other-than planar shape.

Figure 4:
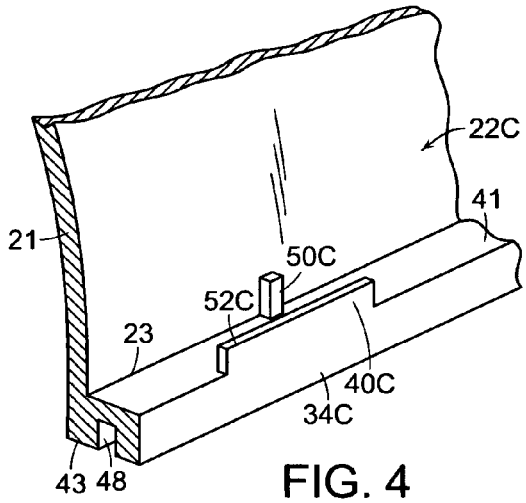
FIG. 4 is an oblique view of a portion of the wall of a half tank showing the integral flange, a nub and a tooth or key on the wall of the tank.

With reference to FIGS. 1, 2 and 4, tank 20 is comprised of a concave wall 21 having a flange 34 which extends outwardly from the edge 23 of the wall. There are alternating peak corrugations 24 and valley corrugations 26. In the central part of the tank the corrugations run transverse to the length of the tank. Each half tank has a circular region 28 near each end, within which a hole may be cut to provide an access port 30 before the tank is buried. See FIG. 2. In use, ports 30 are closed by hatch covers, not shown. Of course, ports are not cut in the half tank which forms bottom part of the tank. The invention may be used with non-corrugated tanks.

Figure 3:
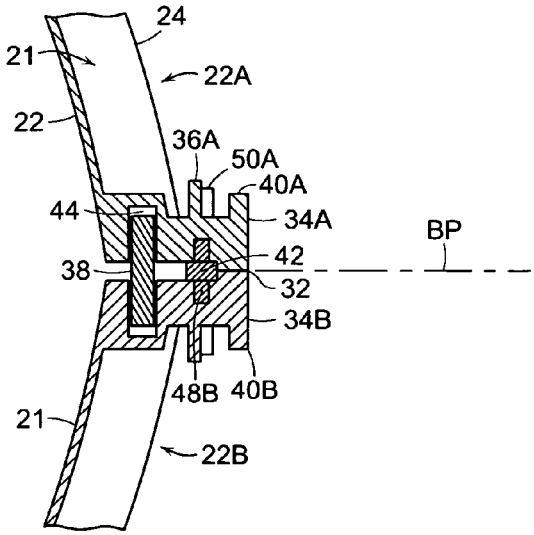
FIG. 3 is a vertical cross section showing the flange joint of the tank shown in FIG. 2.
Figure 7:
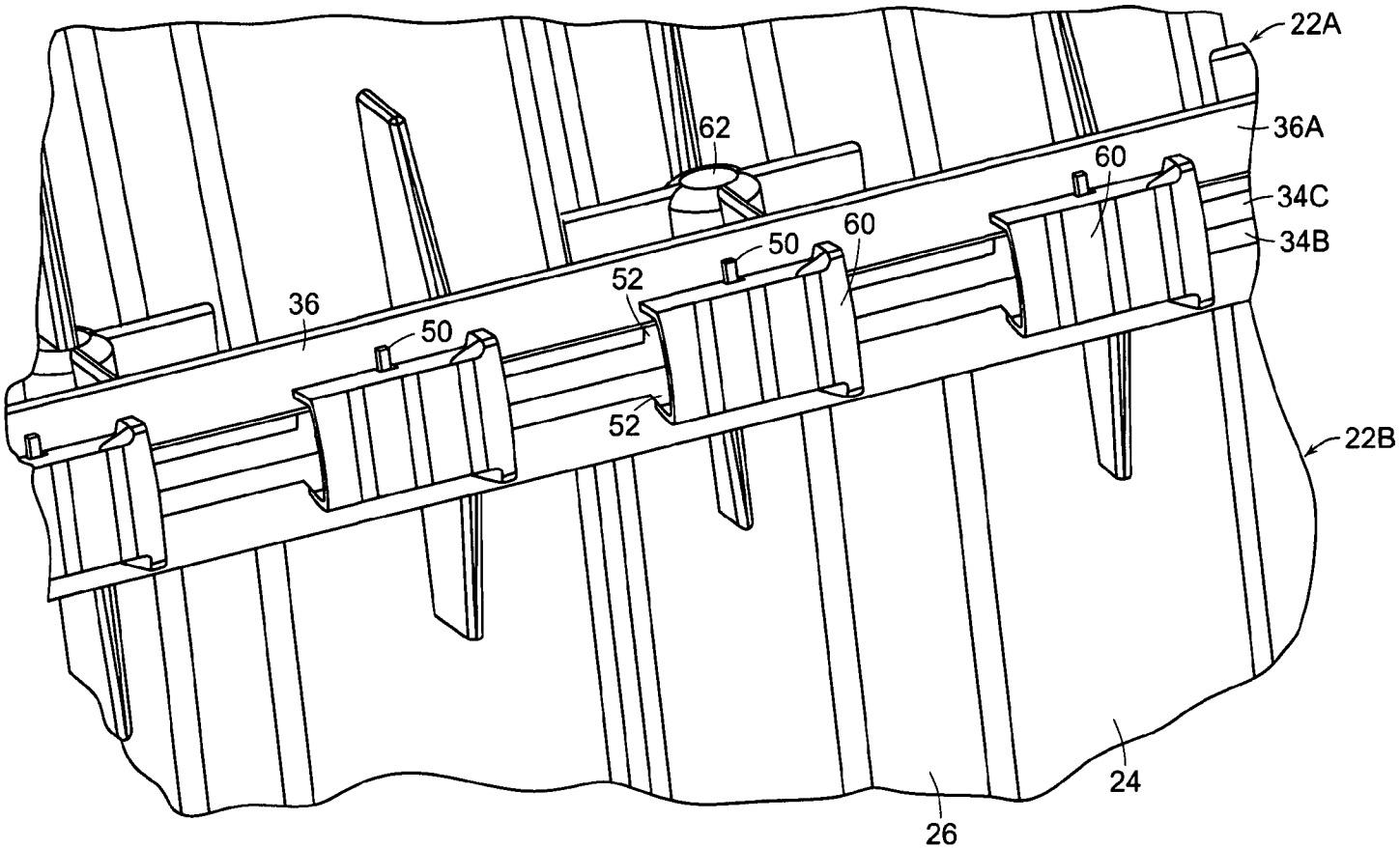
FIG. 7 is a view of a portion of the side of the tank shown in FIG. 2, illustrating a plurality of clamps which are in their locked-in-place home positions.
Figure 8:
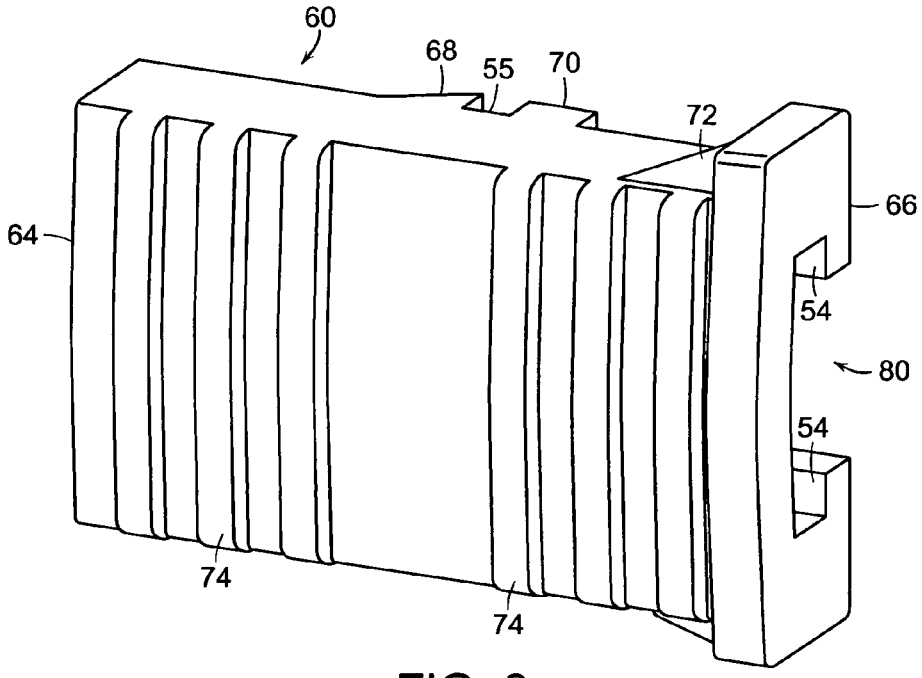
FIG. 8 is a quasi-isometric view of one of the clamps shown in FIG. 7.
Figure 9:
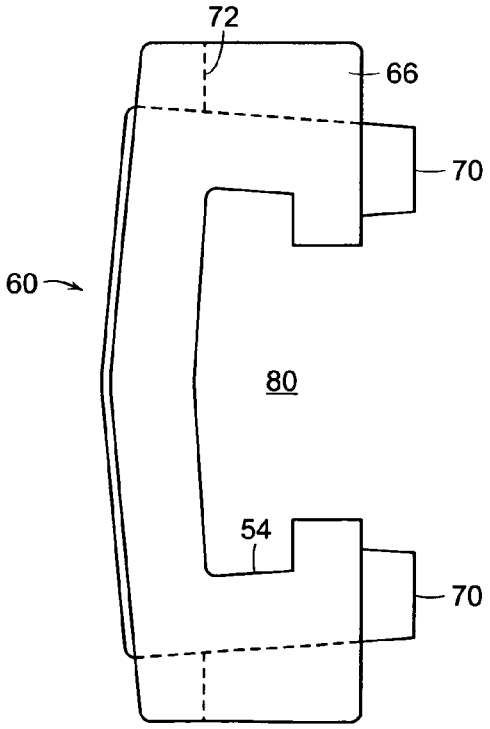
FIG. 9 is a view of the trailing end of the clamp shown in FIG. 8.

FIG. 3 is a vertical cross section through the joint 32 which is formed by mating the flanges 34 of half tanks 22. The half tanks are held together by a plurality of clamps, not detailed in this Figure but described below. Each exemplary flange 34 has nubs 40 near the flange outer edge for receiving clamps, an in-board stiffener 36 for adding section modulus to the flange, and mating grooves 48 shaped to receive a resilient seal 42. Stiffener 36 is also shown in FIG. 7 but for clarity it is omitted in the other views.

Each exemplary half tank 22 has a multiplicity of cylindrical pockets 44 spaced apart along the length of the tank wall inboard of the flange. The pockets 44 receive dowels 38 that facilitate accurate mating of the halves when the top half is lowered onto the bottom half. The exterior end of a pocket 44 is shown in FIG. 7.

Figure 5:
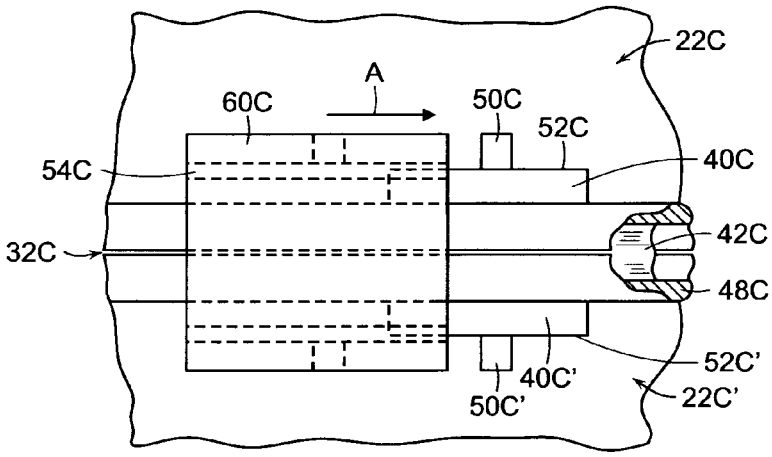
FIG. 5 is a side elevation view of a portion of the side of a tank joint formed by two tank halves having features like those shown in FIG. 4, along with a clamp, as it is being moved to its home position, indicated by the arrow.
Figure 6:
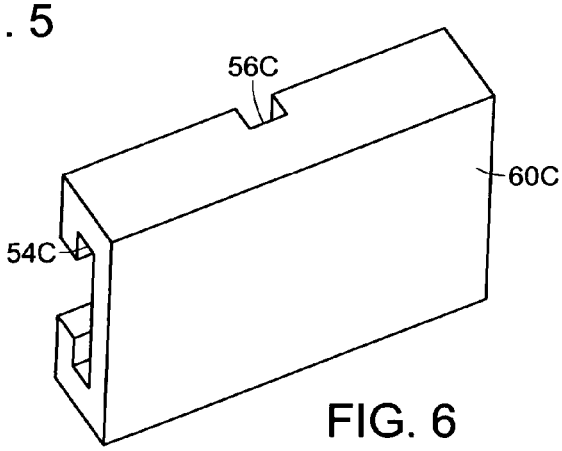
FIG. 6 is an oblique view of the clamp which is shown in FIG. 5.

FIG. 4 through FIG. 6 illustrate, in a simplified embodiment example, some features of the present invention. FIG. 4 shows one of a multiplicity of nubs 40C which are spaced apart along the length of the cantilever or outer edge of the flange 34C of septic half tank 22C. Each nub 40C is a raised portion of the surface 41 of the flange which is spaced apart from the mating surface 43 of the flange. Each nub 40C has a sloped top surface, or free end, 52. (The slopes of parts are exaggerated for clarity or emphasis in this and other Figures.) The side view of FIG. 5 shows half tank 22C mated with an identical half tank 22C'. Clamp 60C is shown as it slides along the flange length (indicated by the arrow A) parallel to the mating plane surface of the flanges, to thereby engage a pair of aligned nubs 40 of the mated half tanks. Clamp 60C has an inner concavity 80 with spaced apart internal grooves 54C, which have groove bottoms that may be parallel or sloped relative to each other. Moving the clamp in the direction of the arrow A creates a wedging action which causes the nubs and the integral half tank flanges 34 to move vertically toward each other, thereby compressing any seal 42 which is present.

In the FIG. 5 embodiment, the free ends 52 of nubs 40 lie along slight converging planes and the bottoms of grooves 54C are substantially parallel. In another embodiment, the nub surfaces 52 may lie in planes parallel to each other and the grooves lie along converging planes. In still another embodiment described in connection with FIG. 7-11, the free ends 52 of the nubs are parallel to each other and the bottoms of the clamp grooves are also parallel to each other.

Clamps preferably have locking features. With reference to FIGS. 4, 5, and 6, when a clamp is pushed sufficiently along the length of a nub 40C, the notch 56C engages tooth 50C which is a molded part of the tank wall that projects toward the nubs. (In FIG. 3 and FIG. 7 a tooth 50 is shown on the flange stiffener 36; but as mentioned above, for simplicity in picturing, the tooth (or any lock-related cavity) is shown on the tank wall. A locking feature of the present invention may be present on a tank wall or on a stiffener or other feature that it integral with the wall and/or flange.)

Notch 56C and tooth 50C are shaped so that, when they become engaged and the clamp is locked in position, the vertical space between the flange mating surface is sufficiently close to obtain a good seal and a mechanically stable joint. The engagement of the notch and tooth prevents the clamp from sliding backwards, and from releasing the force which clamp applies to the flanges and joint. In this and some other embodiments, there are locking features at both of the mated half tanks. In the generality of the invention, a clamp may be locked to only one of the half tanks, since when half tanks are laterally fixed to each other, as here by means of dowels 38, such a clamp will be locked from motion relative to both half tanks. As shown in FIG. 4-6, the notch and tooth preferably have opposing sides which are substantially perpendicular to the lengthwise direction of the clamp and its direction of travel when it is installed. That construction creates a positive engagement, compared to tapered or rounded engagement, and additional force in either direction cannot cause disengagement other than by fracture of a part. A notch is a special case cavity. Other cavities may be substituted for a notch, for example, the notch openings that are described herein may be provided with upper and lower walls to thereby provide a special case pocket cavity; and, of course the tooth would be appropriately shaped to fit in the pocket. Similarly, the term tooth should be construed as being any member which projects from the clamp or half tank, as applies. For example, in FIG. 4, the tooth is a vertically running key.

With reference again FIG. 7 shows how clamps 60 are preferably spaced apart along the length of the mated flanges 34 of half tanks 22. An exemplary tank of nominal 1000 gallon capacity, such as pictured in FIG. 2, may have a length of about 10 feet and a diameter of 5 to 6 feet. Clamps having a length of about 2.8 inches may be spaced apart at about 5 inches on center along an about ⅜ inch thick flange. As and aside, the dome 62 that is visible in FIG. 7 is the exterior upper end of integral molded structure which defines one of the pockets 44, for receiving dowels 38, mentioned above.

Figure 10:
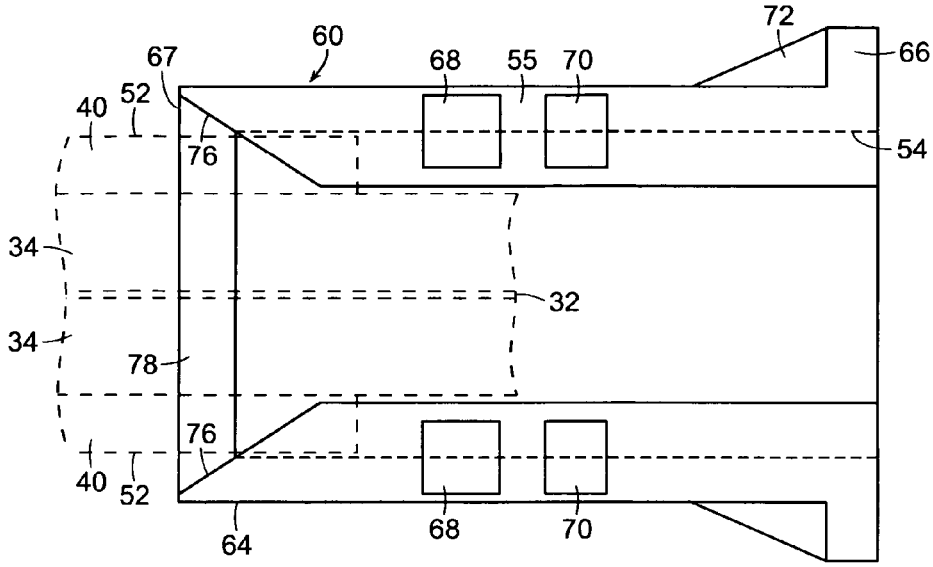
FIG. 10 is a view of the rear side of the clamp of FIG. 8, which side becomes closest to the half tank wall upon installation, in combination with two mated flanges and associated nubs (in phantom), as they are partially engaged by the clamp.

FIG. 8-11 are respectively an oblique view, a rear elevation view, a side view and a top view of a preferred clamp 60. Note that FIG. 10 shows the rear side of a clamp which side, in use, faces the wall of the tank; and also, in phantom, mated flanges and nubs. Clamp 60 has a leading end 64 which a tank assembler first slides along the flange to engage the aligned nubs of mated flanges. As described just below, the end 64 comprises flared portions to ease the first engagement. The exterior of the trailing end 66 of the clamp has a flange-like structure which is of greater dimension than is leading end 64. There is a small buttress 72 to provide strength. Both features 66, 72 strengthen the trailing end of the clamp so it can better absorb blows from a hammer or the like, which may be applied to install the clamp and move it to its home or rest position. Clamp 60 also preferably comprises a multiplicity of exterior-surface strengthening ribs 74 running transverse to the length of the clamp.

Grooves 54 which comprise portions of the C-shape concavity or interior 80 of the clamp, are illustrated in FIG. 8 through FIG. 11. The opposing groove surfaces of a clamp engage a pair of aligned nubs 40 on mated flanges as described above. Preferably, the bottoms of the grooves are parallel to each other and the free ends of the nubs are parallel to each other. In alternative embodiments, the slopes of the grooves and nub surfaces may be non-parallel.

Figure 11:
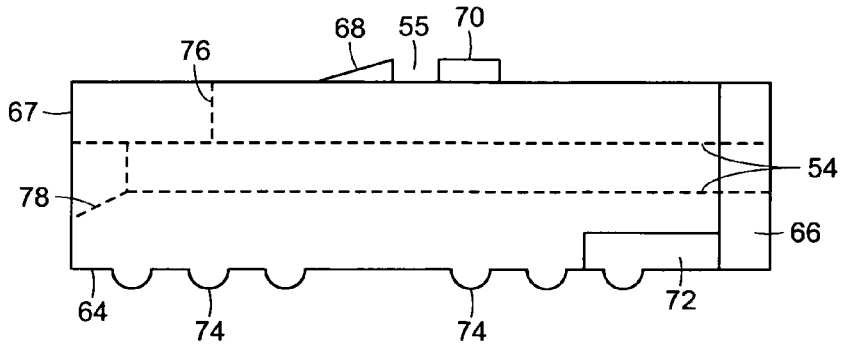
FIG. 11 is a top view of the clamp of FIG. 8.
Figure 14:
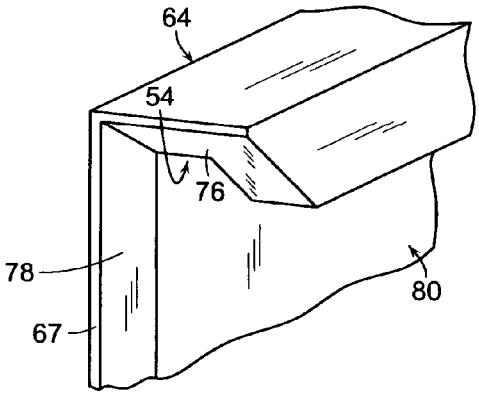
FIG. 14 is a quasi-isometric partial view of the leading end of a clamp.

FIGS. 10, 11 and 14 show details of the interior of clamp 60, in particular of the leading end 64. End 64, which first engages nubs upon installation, has a vertically running flare 78. Flare 78 angles from a vertical plane of the clamp length, as the clamp is shown in the FIG. 10. The top and bottom flares 76 angle up and down relative to the horizontal plane in FIG. 10, i.e., relative to the plane of the joint between the mated flanges. See also FIG. 14. The flares 76, 78, run from the terminus 67 of the leading end 64 of the clamp. The flares facilitate the engagement of a clamp with mated nub pairs, particularly when the free ends of the nubs are parallel to each other and the plane of the flange joint, and the clamp grooves are parallel to each other.

As clamp 60 is first being engaged with a mated nub pair, vertical flare 78 allows the clamp to be angled and twisted about a vertical axis VL which is nominally perpendicular to the horizontal plane BP of the mating flange joint 32, as such features are illustrated seen in FIG. 2 and FIG. 3. (The axis VL will translate laterally a bit as the clamp is simultaneously twisted and moved lengthwise.) This feature is particularly useful when nub pair locations are closely spaced apart horizontally, or when there are other tank wall features which limit a "straight-on" engagement of a clamp with the nub pairs. The top and bottom flares make easier the initial entry into a groove of the free surfaces 52 of opposing nub pairs when the joint surfaces of the flanges are spaced apart from their final or home/use position. In the generality of the invention, a clamp which has parallel-bottom grooves may have flares at each end, so that the clamp may be moved nubs from either direction (in which case, for example, feature 70 in FIG. 11 would also be a ramp like feature 68).

To summarize the foregoing: In embodiments of the invention, a clamp has a body with a C-shape cross section, defining an interior length-wise concavity and internal grooves. The clamp engages at the groove location pairs of nubs, one nub on each of the mated flanges. The surfaces of aligned nubs may be parallel, or they may be angled relative to each other and relative to the plane of the joint. The internal grooves of a clamp may be parallel to each other or they may have an included angle between them. Clamps of either style may be used with nubs of either style, with potential differing degrees of force and restraint being applied to the mated flanges. Preferred nubs have lengths substantially greater than their nub heights, where height is distance between a flange second surface and the free end of the a nub. When a clamp is first engaged with the nub pair, the clamp is angled with respect to the nub length along the flange; and as the clamp is further engaged, the clamp is swiveled or twisted in the plane of the joint between the mated half tank flanges.

As pointed out in connection with FIGS. 4 and 5, when the clamp reaches to its desired home position, i.e., its final rest position, further motion is prevented by engagement of a feature on the clamp with a corresponding feature on the tank wall. For instance, in FIG. 7 the notch 55 of clamp 60 engages tooth 50.

Figure 12:
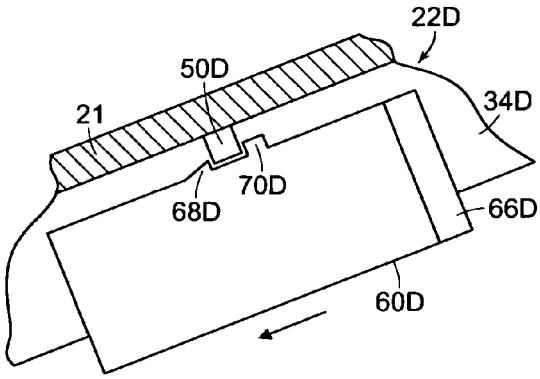
FIG. 12 is a top view of a clamp similar to one of those shown in FIG. 7, showing the clamp locked in place by engagement of a clamp notch with a tooth or protuberance on the tank half wall.

Clamp 60 preferably has two spaced apart lands 68, 70 which define the notch 55. As evident from FIGS. 8 and 11, as clamp 60 moves along the flange, the ramp of sloped land 68 will first contact tooth 50. The dimensions of the clamp and half tank are chosen so that resilience of the clamp and tooth enable them to deflect a small amount relative to each other after they contact and interfere with one another. Thus, when further lengthwise force is applied to the trailing end 66 of the clamp, tooth 50 "rides up" the ramp or sloped portion of land 68. Finally, the point is reached where resilient force causes the tooth to drop into notch 55, thereby locking the clamp from motion in either direction. The engagement of the clamp with the tooth at the home position is shown in FIG. 12 for comparable clamp 60D.

In an alternate embodiment, not shown, land 70, 70D is not present on exemplary clamps 60, 60D. In such instance, when clamp is sufficient driven, the home position point is reached where the tooth "falls off" the land 68, and reverse motion of the clamp will be prevented. In this configuration of locking means, consequential further forward motion of the clamp might be resisted due to interference of the nubs within the opposing side grooves of the clamp, i.e., when one or the other is tapered. The presences of features corresponding with both of the lands 68, 70 is useful in that locking in both-directions prevents a tank assembler from over-driving the clamp and possibly causing it to move beyond the desired home position, and off the nubs or possibly the clamp can be broken due to "over-wedging.".

Figure 15:
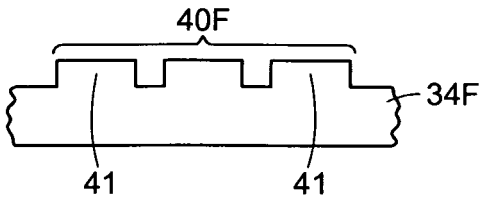
FIG. 15 is a side elevation view of a nub which is comprised of spaced apart sub-elements.

While nubs have been described thus far as unitary structures, in the generality of the invention nubs may be comprised of discrete sub-elements. For example, FIG. 15 shows how three closely spaced sub-elements 41 comprise nub 40F on flange 34F.

Figure 13:
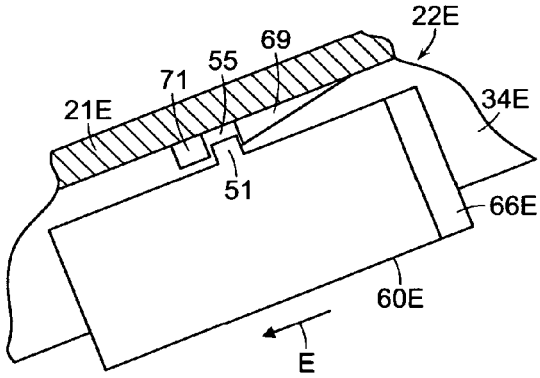
FIG. 13 is a view like that of FIG. 12, showing another clamp and tank wall embodiment, in which the clamp is locked in place at its home position by means of a tooth projecting from the clamp.

FIG. 13 shows an alternate embodiment of clamp and tank configuration. Clamp 60E has a tooth 51 which projects outwardly. When the clamp is installed on the nubs, as indicated by the movement arrow E, the tooth 51 first engages ramp 69 of land 71, which is molded onto the side of the tank. There is resilient deflection of the parts, as described above. With sufficient lengthwise force and resultant motion, tooth 51 falls into notch 55 on the wall of the tank, between lands 69, 71. Corresponding with what was described above, a variation on this embodiment omits land 71.

Figure 16:
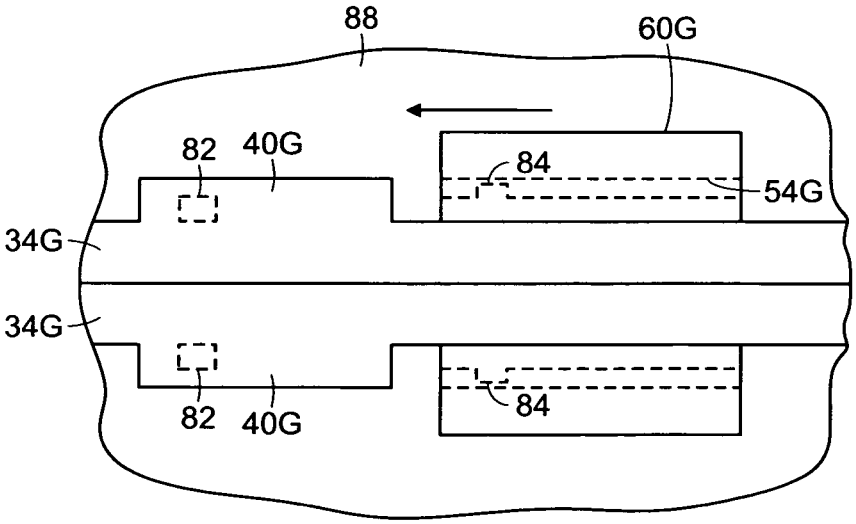
FIG. 16 is a side elevation view somewhat like FIG. 10, showing another clamp embodiment with a portion of mated tank flanges and associated walls. The clamp is moving toward engagement with the nubs as indicated by the arrow.

FIG. 16 shows another exemplary embodiment in which clamp 60 has a notch 84 at each of the terminal ends of the C shape body. When the clamp moves, as indicated by the arrow, to its home position, the notch is engaged by an upward-projecting tooth 82 which is on the side of the nub 40G and which faces in the direction of the tank wall 88 in the picture.

The tooth and a mating notch may respectively have other cross sections and shapes than the rectangular shape shown. For example, the tooth may have a semi-round configuration or a triangle configuration, and the notch may correspondingly have a shape which is a reverse image of such configuration. However, such shapes provide lesser degree of positive locking than do preferred locking features, where engagement surfaces are substantially perpendicular to the direction of sliding engagement of the clamp with the nub pairs.

Still other means for locking a clamp may be used in addition to, or in substitution of, the embodiments thus far described. For example, there may be a protuberance on the nub surface which engages a pocket within the groove of a clamp; the trailing end of the clamp may have a tooth which engages a notch on the surface of the flange or nub; the flange may have a tooth which engages a notch in the clamp; or a pin may be slipped into an appropriately located hole in the flange or tank wall, so the pin projects into the clamp rearward path; or a small wedge may be jammed between the trailing end of the clamp and the flange surface. In carrying out the invention, a clamp may be locked in home position by more than one different means for locking. Alternately, in carrying out the invention involving the flaring, a clamp may have no means for locking.

The half tanks of the invention may be made of a thermoplastic such as polypropylene or high density polyethylene. In the generality of the invention, the half tanks may be made by means other than injection molding, and they may be made of a non-thermoplastic resin. A clamp of the present invention is preferably made of glass-filed polypropylene, or other reinforced or engineered plastic. Alternately, the clamp may be made of other materials, including metals and plastics. Some features of exemplary half tanks are described in somewhat more detail in a commonly owned related U.S. patent application of R. Moore, Jr. et al., filed on even date hereof, bearing Ser. No. 13/412,466, and entitled "Manipulating and Restraining a Plastic Septic Tank." The disclosure of the foregoing application is hereby incorporated by reference.

In use of the tank kit, the half tanks and clamps are injection molded at a factory using known molding methods. The half tanks are nested, typically concave wall down, for storage or transport to an assembly point, which could be the point of installation of the tank in the soil. Tanks may be economically shipped as kits to a distant point, since the half tanks can be nested. At the assembly point, exemplary steps for forming a tank comprise:

(a) Mating the half tanks to each other by placing the joint surface of one in close proximity to the joint surface of the other, thereby forming a joint, wherein due to the design and construction of the half thanks, the nubs on one half tank are aligned with nubs on the other half tank, to form associated nub pairs, each for receiving a clamp.

(b) Engaging the leading end of a clamp with each nub pair by sliding the clamp lengthwise and capturing a nub in each of the opposing side grooves of the clamp, so that the flanges become fastened, or attached, to each other by action of the clamp. During the initial part of step (b), a clamp is angled about a vertical axis which is nominally perpendicular to the plane of the joint between the flanges as it is slid lengthwise, to engage an aligned nub pair. Angling of the clamp as the leading end is simultaneously being engaged with nubs is enabled by clamp flare 78. The flare avoids interference of the clamp body with the edge of the mated flanges; and it allows the spacing between adjacent clamps to be less than the length of a clamp. The angling motion is carried out in coordination with lengthwise sliding motion. Accomplishing the initial lengthwise engagement with the nubs is facilitated by having at least one flare 76, angled with respect to the horizontal plane of the flange joint, at the leading end interior of the clamp.

(c) The assembler next slides each clamp lengthwise in a direction parallel to the joint between the mated flanges, and moves the clamp to its home position, to further engage the clamp with a pair of aligned nubs. Doing that often requires blows on the trailing end with a mallet or heavy object, according to the fit between the parts. Depending on the locking means which is present, the motion of the clamp will be stopped when the home position is reached. With the precision that is obtainable with injection molded tank halves and injection molded clamps, the clamp and mating nub pair free surfaces cooperate to move the flanges together (or alternatively to hold them together if separate means have been used to draw them together), thereby compressing the seal and forming a good joint.

The foregoing system of making tanks from half tanks has been found advantageous. The clamps may be installed without special fixtures and only a mallet. Yet they hold the flanges of the tanks together well and a leak proof joint can be created.

The invention may be used with tanks where the half tanks, or the mating flanges and associated features of half tanks, are not identical. The principles of the invention may be applied to half tanks joints which are not entirely planar, and a reference to the plane of the joint for such kinds of tanks is a reference to the nominal or mean plane of the joint. A tank may have more than one joint. For instance, a tank may have a bottom concave piece, a middle cylindrical piece, and an upper concave piece, so that there are two clamped joints in the assembled tank.

The invention, with explicit and implicit variations and advantages, has been described and illustrated with respect to one or more embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail without departing from the spirit and scope of the claimed invention.

What is claimed is:

1. An injection molded plastic tank having an interior for containing fluids comprising:

(a) a first injection molded plastic half tank comprising a concave wall having an edge with a first flange running therealong;

(b) a second injection molded plastic half tank having a concave wall and comprising an edge with a second flange running therealong;

each flange having a first surface for mating with the flange of the other half tank;

a second surface spaced apart from the first surface by the thickness of the flange; and, a multiplicity of nubs spaced apart along said second surface, each nub having a free end spaced apart from said second surface;

wherein the flanges of the half tanks are mated to each other and the mated half tanks thereby define said tank interior and wherein said multiplicity of nubs on each of the mated flanges form a plurality of mated nub pairs; and, (c) a multiplicity of clamps, each clamp having (i) a C-shape cross section body having an interior concavity extending along a length axis thereof;

(ii) opposing side grooves running lengthwise within the interior concavity of the C-shape cross section body, each groove having a groove bottom, and (iii) a first inwardly flared portion running between said grooves and transverse to the length of the clamp at one lengthwise end of the clamp for enabling lengthwise engagement of said clamp with a mated nub pair;

wherein each clamp is twistable lengthwise in a plane parallel to said flange first surface when the clamp is partially engaged with a mated nub pair; and wherein each clamp is engaged with a mated nub pair, thereby holding fixedly to each other said half tank flanges.

2. The tank of claim 1 wherein each clamp further comprises an third inwardly flared portion running to the bottom of each opposing side groove at said one lengthwise end of the clamp.

3. The tank of claim 1 wherein the nubs of each half tank have free ends which are parallel to each other; wherein the opposing side grooves have bottoms which are parallel to each other; and, wherein each clamp has an inwardly flared portion running to the bottom of each opposing side groove at said one lengthwise end of the clamp.

4. The tank of claim 1 further comprising means integral with the tank for locking a clamp to a half tank, to prevent lengthwise motion of a clamp relative to a mated pair of nubs with which the clamp is engaged; wherein said locking means becomes effective as the clamp is moved lengthwise sufficiently to fully engage a mated nub pair.

5. The tank of claim 4 wherein the means for locking comprises a tooth or cavity on a half tank and a mating cavity or tooth on the clamp; each of the tooth and cavity comprising a planar surface which is substantially perpendicular to the length of the clamp.

6. The tank claim 5 wherein the means for locking comprises a tooth on a half tank, and a mating notch cavity on the clamp.

7. The tank of claim 5 wherein the means for locking comprises a tooth on a clamp and a mating cavity on half tank, shaped to receive the tooth.

8. The tank of claim 1 wherein each nub of a mated nub pair is comprised of a multiplicity of nub sub-elements.

9. The tank of claim 1 wherein the two half tanks are identical in shape.

10. The tank of claim 1 wherein the end of the clamp opposing said one lengthwise end having said flared portions is large in exterior dimension than the other portions of the said C-shape cross section body, to thereby provide a thicker region for hammer blows.

11. The tank of claim 1 wherein the end of the clamp opposing said one lengthwise end having said flared portions is large in exterior dimension than the other portions of the said C-shape cross section body, to thereby provide a thicker region for hammer blows.

12. A kit for assembling a molded plastic tank having an interior for containing fluids comprising:

(a) a first molded plastic half tank comprising a concave wall having an edge, with a first flange running therealong;

(b) a second molded plastic half tank having a concave wall comprising an edge, with a second flange running therealong;

each flange having a first surface, for mating with the flange of the other half tank;

a second surface spaced apart from the first surface by the thickness of the flange; and, a multiplicity of nubs spaced apart along said second surface, each nub having a free end spaced apart from said second surface;

wherein, when during use the flanges of said half tanks are mated to each other at said flange first surfaces, the mated half tanks define said plastic tank interior and the pluralities of nubs on said mated flanges form a plurality of mated nub pairs; and, (c) a multiplicity of clamps, each clamp having (i) a C-shape cross section body having an interior concavity extending along a length axis thereof;

(ii) opposing side grooves running lengthwise within the interior concavity of the C-shape cross section body each groove shaped to engage a nub on a flange; and, (iii) at least one inwardly flared portion running between said grooves and transverse to the length of the clamp into said clamp interior concavity at one lengthwise end of the clamp, for enabling twistable lengthwise engagement of said clamp with a mated nub pair.

13. The kit of claim 12 wherein each clamp further comprises an inwardly flared portion associated with each of said grooves at said one lengthwise end of the clamp.

14. The kit of claim 12 wherein said nubs have free ends which are sloped relative to said flange first surface; and wherein each clamp and each half tank have integral locking means which may be mated to lock the clamp against lengthwise motion relative to the mated nub pair.

15. The kit of claim 12 wherein said mating locking means comprise a tooth on either the tank wall or on the clamp body; and a mating cavity on either the clamp body or the tank wall, for receiving and positively engaging said tooth.

16. The kit of claim 12 wherein, within a mate-able pair of nubs, the nubs have free ends which are parallel to each other when the tank flange first surfaces are mated to each other; and wherein the opposing side grooves of each of said clamps are sloped relative to each other and the length of the clamp body.

17. The kit of claim 12 wherein the two half tanks are identical in shape.

18. An injection molded plastic tank having an interior for containing fluids comprising:

(a) a first injection molded plastic half tank comprising a concave wall having an edge with a first flange running therealong;

(b) a second injection molded plastic half tank having a concave wall and comprising an edge with a second flange running therealong;

each flange having a first surface for mating with the flange of the other half tank;

a second surface spaced apart from the first surface by the thickness of the flange; and, a multiplicity of nubs spaced apart along said second surface, each nub having a free end spaced apart from said second surface;

wherein the flanges of the half tanks are mated to each other and the mated half tanks thereby define said tank interior and wherein said multiplicity of nubs on each of the mated flanges form a plurality of mated nub pairs which have nub free ends which are parallel to each other; and, (c) a multiplicity of clamps, each clamp having (i) a C-shape cross section body having an interior concavity extending along a length axis thereof;

(ii) opposing side grooves running lengthwise within the interior concavity of the C-shape cross section body and having bottoms which are parallel to each other; and, (iii) an inwardly flared portion running from the end of the clamp and having an angle of inclination that extends to the bottom of at least one side groove;

wherein each clamp is engaged with a mated nub pair, thereby holding fixedly to each other said half tank flanges.

19. The tank of claim 18 further comprising means integral with the tank for locking a clamp to a half tank, to prevent lengthwise motion of a clamp relative to a mated pair of nubs with which the clamp is engaged; wherein said means for locking becomes effective as the clamp is moved lengthwise sufficiently to fully engage a mated nub pair.

* * * * *